US010364561B2

(12) United States Patent
Arens et al.

(10) Patent No.: US 10,364,561 B2
(45) Date of Patent: Jul. 30, 2019

(54) DRAIN VALVE FOR A FLUSHING CISTERN AND FLUSHING CISTERN HAVING A DRAIN VALVE

(71) Applicant: Viega Technology GmbH & Co. KG, Attendorn (DE)

(72) Inventors: Klaus Arens, Wenden (DE); Frank Fulgoni, Sundern (DE); Patrick Dietermann, Lennestadt (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 0 days.

(21) Appl. No.: 16/077,222

(22) PCT Filed: May 8, 2017

(86) PCT No.: PCT/EP2017/060907
§ 371 (c)(1),
(2) Date: Aug. 10, 2018

(87) PCT Pub. No.: WO2017/194463
PCT Pub. Date: Nov. 16, 2017

(65) Prior Publication Data

US 2019/0032314 A1 Jan. 31, 2019

(30) Foreign Application Priority Data

May 9, 2016 (DE) ..... 10 2016 108 510

(51) Int. Cl.
*E03D 1/14* (2006.01)
*E03D 1/35* (2006.01)

(52) U.S. Cl.
CPC ..... *E03D 1/144* (2013.01); *E03D 1/35* (2013.01)

(58) Field of Classification Search
CPC ..... E03D 1/144; E03D 1/35
USPC ..... 4/325, 390, 391, 397, 398, 414
See application file for complete search history.

(56) References Cited

U.S. PATENT DOCUMENTS 5,249,313 A * 10/1993 Chang ..... E03D 1/142 4/325
2009/0025129 A1* 1/2009 Le ..... E03D 1/144 4/324

FOREIGN PATENT DOCUMENTS

| | | | |
|---|---|---|---|
| DE | 2009654 | | 9/1971 |
| DE | 29906646 | U1 | 7/1999 |
| DE | 102007001718 | A1 | 5/2008 |
| EP | 1195475 | A2 | 4/2002 |
| EP | 2149644 | A2 | 2/2010 |
| GB | 2396163 | A | 6/2004 |
| WO | 2008041057 | A1 | 4/2008 |

* cited by examiner

*Primary Examiner* — Tuan N Nguyen
(74) *Attorney, Agent, or Firm* — The Webb Law Firm

(57) ABSTRACT

The invention relates to a drain valve for a sanitary flushing cistern, in particular a flush-mounted flushing cistern, including a valve housing and a valve body guided in the valve housing and configured as an overflow pipe having a seal assigned to a valve seat, wherein the valve body is provided with at least one pull tab for lifting the valve body, and one buoyant body.

12 Claims, 7 Drawing Sheets

Fig.4
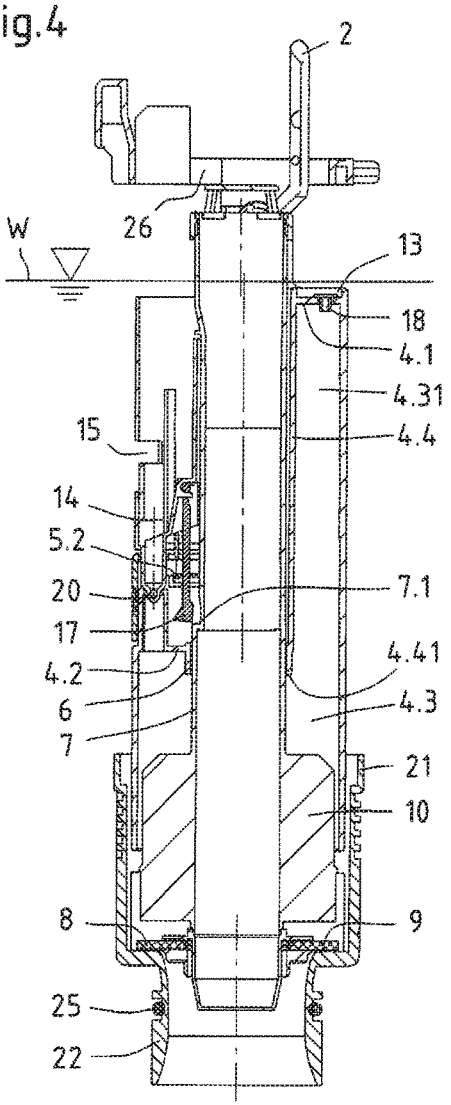
Fig.2
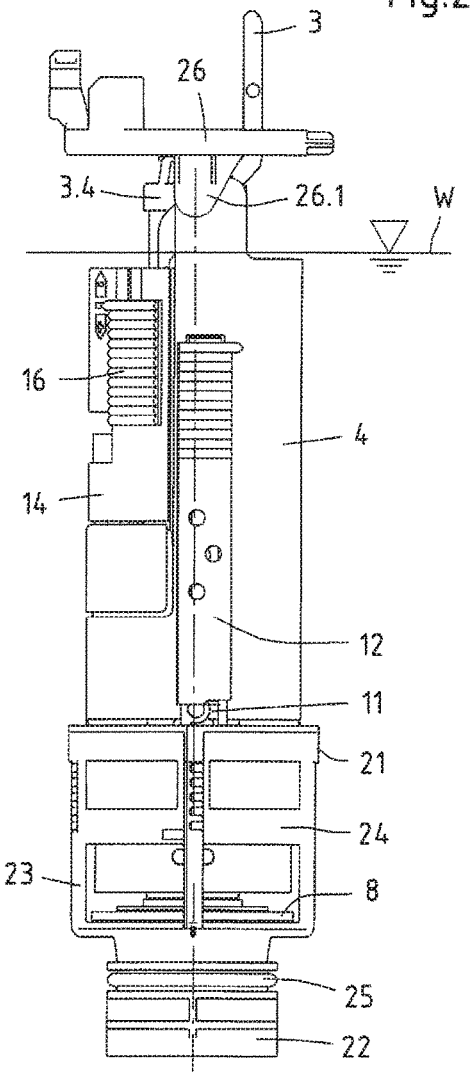
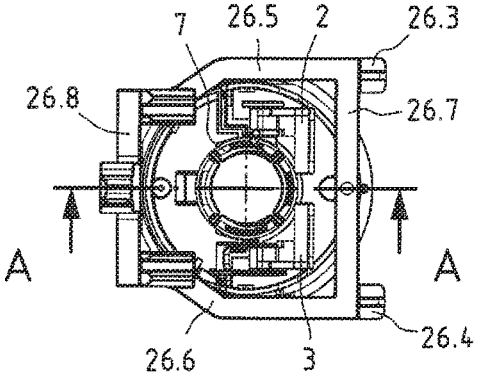
Fig.3

DRAIN VALVE FOR A FLUSHING CISTERN AND FLUSHING CISTERN HAVING A DRAIN VALVE

CROSS-REFERENCE TO RELATED APPLICATIONS

This application is the United States national phase of International Application No. PCT/EP2017/060907 filed May 8, 2017, and claims priority to German Patent Application No. 10 2016 108 510.3 filed May 9, 2016, the disclosures of which are hereby incorporated in their entirety by reference.

BACKGROUND OF THE INVENTION

Field of the Invention

The invention relates to a drain valve for a sanitary flushing cistern, in particular a flush-mounted flushing cistern, having a valve housing and a valve body guided in the valve housing and formed as an overflow pipe including a seal assigned to a valve seat, the valve body being provided with at least one pull tab for lifting the valve body and with one buoyant body. Furthermore, the invention relates to a sanitary flushing cistern, preferably in the form of a flush-mounted flushing cistern, having a rear wall, a front wall and a drain valve, a revision opening being formed in the upper portion of the front wall for installing and removing the drain valve.

Description of Related Art

Drain valves of the aforementioned type have been known in a variety of configurations for a long time. For a reliable functioning of the drain valve, the drain valve has to be substantially vertically aligned and fixed in the flushing cistern. For fixing conventional drain valves for flushing cisterns, separate additional parts in the form of hold-down devices and spacers are used. The alignment and fixing of conventional drain valves for flushing cisterns often turns out to be difficult, in particular if the drain valve has to be removed through a revision opening formed in the front wall of a flush-mounted flushing cistern and subsequently be reinstalled. The revision opening is relatively small, while drain valves for flushing cisterns typically feature a relatively long design. For this reason, the installer has to have a good command of handling the difficult removal and installation of the drain valve.

On this basis, the object of the invention is to create a drain valve of the type mentioned at the outset, which is easier to install in flushing cisterns, in particular flush-mounted flushing cisterns, as well as easier to remove from the flushing cistern in the case of maintenance or repair work.

SUMMARY OF THE INVENTION

The drain valve according to the present invention is characterised in that the valve housing at its upper end is provided with a spacer for aligning and fixing the drain valve in the flushing cistern, the pull tab being pivotably connected to the valve body and the spacer having an abutment assigned to the pull tab, which functions as the pivot point for the pull tab, so that the pull tab is movable from an upright position into a folded position and so that the valve body connected to the pull tab in the folded position of the pull tab is raised vis-à-vis the valve seat.

The spacer connected to the valve housing thus represents an integrated component of the drain valve according to the invention. The integrated spacer enables that the valve drain can be intuitively oriented and fixed in the flushing cistern. In order to align and fix the drain valve in the flushing cistern, no additional part is required as a space holder. The outer dimensions of the spacer correspond to interior surfaces of the flushing cistern in such a manner that the flushing cistern is reinforced by inserting the drain valve having the integrated spacer. In addition, the length of the drain valve can be shortened when folding over the pull tab. In so doing, the handling of the drain valve when being installed or removed is significantly simplified and, thus, improved. The integrated spacer somewhat increases the lateral dimensions of the drain; however, installing and removing the drain valve is not consequently compromised. Rather, the advantage resulting from shortening the length of the drain valve when folding over the pull tab significantly outweighs the relatively small increase of the lateral dimensions of the drain valve.

One advantageous embodiment of the drain valve according to the invention provides that the spacer is rotatably mounted at the upper end of the valve housing. The rotary axis preferably runs substantially perpendicular to the vertical longitudinal axis of the drain valve. Particularly preferably, the rotary axis of the spacer runs substantially parallel to the rear wall of the flushing cistern or parallel to the pivot axis of the foldable pull tab. Rotatably mounting the spacer at the upper end of the valve housing further simplifies the handling of the drain valve when being installed and removed. Rotatably mounting the spacer at the upper end of the valve housing can be implemented in a functionally simple and reliable manner in that, according to a preferable embodiment of the invention, the spacer has downward facing articulated arms rotatably mounted by pins at the valve housing.

According to a further embodiment of the invention, the spacer is configured in a frame-shaped manner and at its rear side has one or a plurality of protrusions assigned to the rear wall of the flushing cistern. From a construction viewpoint, the frame-shaped design of the spacer is advantageous for a rotatable connection of the spacer to the upper end of the valve housing. The protrusion(s) provided at the rear side of the spacer assigned to the rear wall of the flushing cistern enable achievement of a very easy and reliable alignment and fixing of the drain valve in the flushing cistern.

Preferably, the frame-shaped spacer is tapered in the direction of its front side or in the direction of the abutment assigned to the pull tab. In so doing, the increased lateral dimensions of the drain valve resulting from the spacer are kept small. For example, the frame-shaped spacer seen from a top view may have curved, angled or cranked side rails. In particular, the rearmost rail of the frame-shaped spacer facing the rear wall of the flushing cistern has greater dimensions than the front rail of the spacer facing the front wall of the flushing cistern.

According to a further embodiment of the invention, the folding mechanism of the pull tab is configured in such a manner that the abutment assigned to the pull tab protrudes at the top side and has a groove for receiving a portion of the pull tab. In that the abutment protrudes at the top side of the spacer, a large upstroke of the valve body (overflow pipe) can be accomplished for shortening the length of the drain valve while achieving comparably compact dimensions of the drain valve. The groove for receiving the portion of the pull tab secures the position of the pull tab if it is in its folded state.

The top, foldable portion of the pull tab is preferably configured in an angular shape, the first segment of the foldable portion having an oblong lug for coupling the pull tab to a lifting mechanism, and a second segment connecting to this first segment, which encloses an angle in the range of 120° to 150°, preferably in the range of 130° to 140°, with the first segment, and which is pivotably connected to the valve body (overflow pipe).

Preferably, the drain valve according to the invention is configured as a dual flush drain valve. In this case, the drain valve has a second pull tab pivotably mounted at the drain valve, the spacer having a second abutment assigned to the second pull tab functioning as a pivot point for the second pull tab so that the second pull tab is movable from an upright position into a folded position.

A further advantageous embodiment of the drain valve according to the invention is in that the two abutments at their outer sides facing away from each other respectively have a three-dimensionally structured gripping surface. Thus, the abutments also serve as a grip when installing and removing the drain valve. The three-dimensionally structured gripping surface ensures a non-slip handling of the drain valve. Furthermore, the installer of the drain valve easily understands that the three-dimensional structure of the gripping surfaces are meant to serve as gripping surfaces.

A further advantageous embodiment of the valve drain valve according to the invention is characterised in that the spacer is provided with a latching element, with the aid of which the first-mentioned pull tab or the second pull tab in its folded position is able to releasably latch to the spacer. In so doing, the shortened state of the drain valve resulting from folding over the respective pull tab is reliably ensured, as a result of which the simplified handling of the drain valve is further improved during installation and removal.

According to a further embodiment of the drain valve according to the invention, the valve housing at its lower end is provide with a bracket having the valve seat, vertical spacers and an outlet connecting piece, the valve housing being releasably connected to the bracket. The valve housing can thus be separated from the bracket having the valve seat. In so doing, the length of the drain valve is particularly advantageously shortened for its installation and removal. In particular, when separating the valve housing from the bracket having the valve seat, not only the folding of the pull tab(s) but also the lifting of the valve body (overflow pipe) can be used with regard to shortening the length of the drain valve.

An advantageous embodiment of a sanitary flushing cistern according to the invention, preferably a flush-mounted flushing cistern, which has a rear wall, a front wall and a drain valve according to the invention, a revision opening being formed in the upper portion of the front wall for installing and removing the drain valve, is characterised in that the rear wall at its inside has at least one recess and/or at least one protrusion for a positive locking of the spacer. This design contributes to an improved alignment and fixing of the drain valve according to the invention. Preferably, one or a plurality of angularly shaped protrusions are formed at the inside of the back wall of the flushing cistern, which are gripped upon from below by the spacer or by the protrusions rearwardly protruding from the spacer in the installed state of the drain valve.

Subsequently, the invention is explained in greater detail on the basis of drawings showing exemplary embodiments. In the drawings:

BRIEF DESCRIPTION OF THE DRAWINGS

FIG. 2 shows the drain valve from FIG. 1 in a side view;

FIG. 3 shows the drain valve from FIG. 1 in a top view;

FIG. 4 shows a longitudinal sectional view of the drain valve from FIG. 1 along intersection line A-A in FIG. 3;

DESCRIPTION OF THE INVENTION

Figure 1:
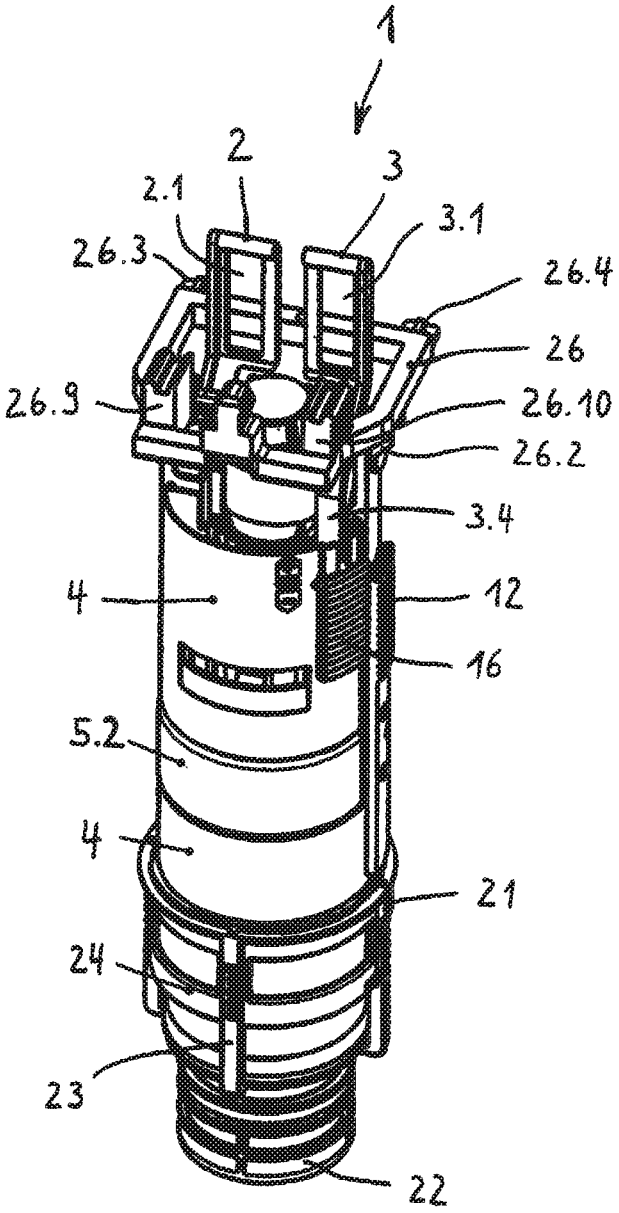
FIG. 1 shows a drain valve according to the present invention in a perspective view.
Figure 5:
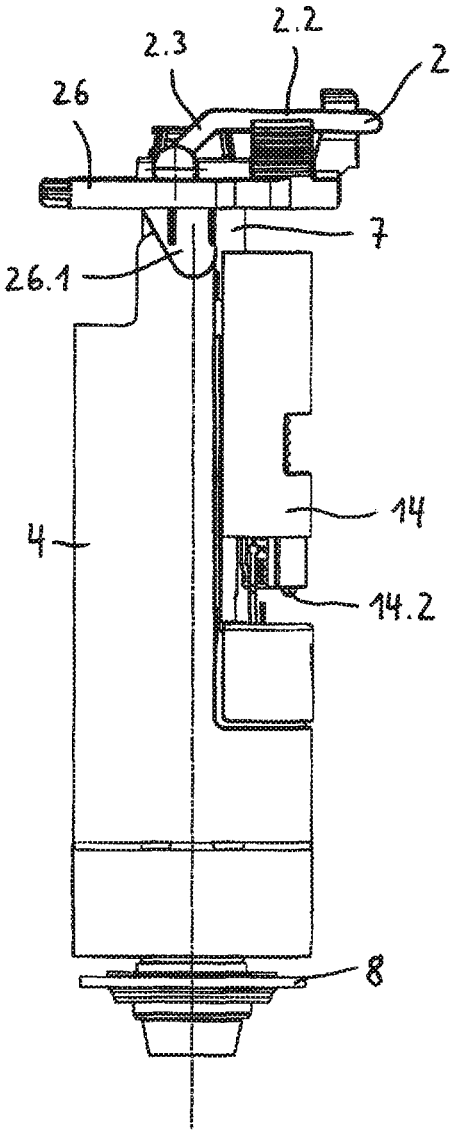
FIGS. 5 and 6 show two further perspective views of the drain valve, the pull tabs of the drain valve being shown in their upright position in FIG. 6 and in their folded position in FIG. 5.
Figure 6:
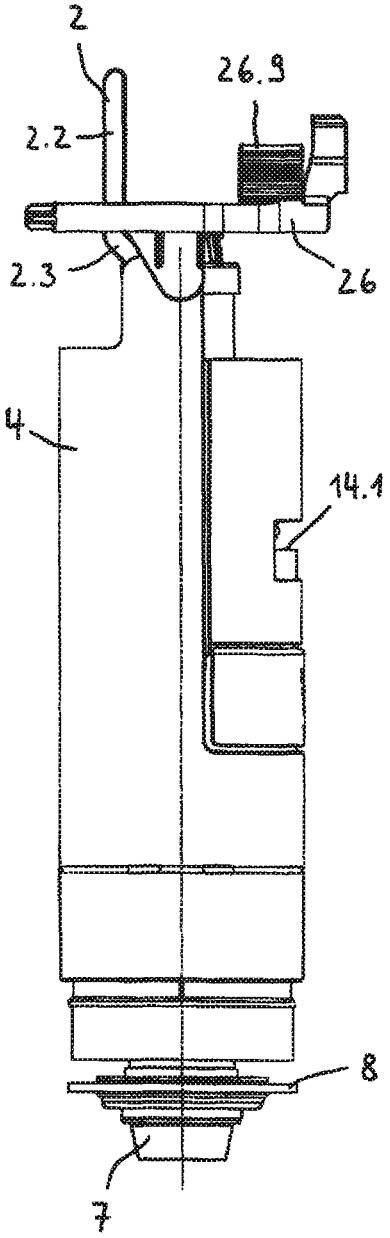
Figure 7:
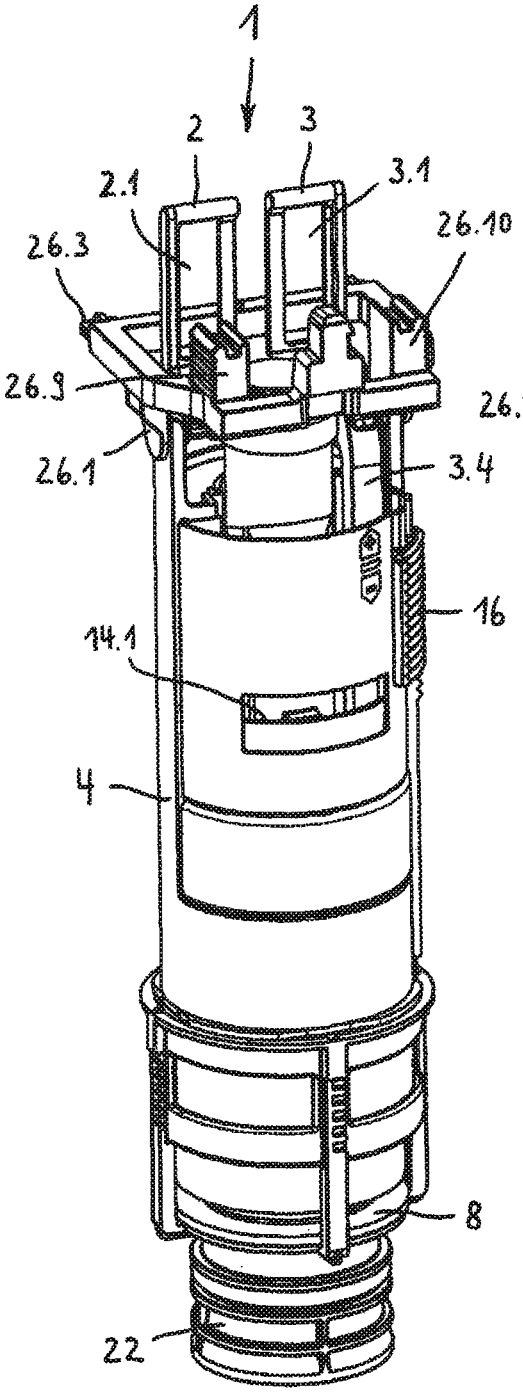
FIGS. 7 and 8 show two further side views of the drain valve, the pull tabs of the drain valve being shown in their folded position in FIG. 8 and in their upright position in FIG. 7.

The figures of the drawing show a drain valve 1 insertable into a sanitary flushing cistern, in particular a flush-mounted flushing cistern. Drain valve 1 is preferably configured as a dual flush drain valve, meaning that it optionally can flush a larger quantity of flushing water for a so-called full flush or a smaller quantity of flushing water for a so-called partial flush. In order to actuate the drain valve 1, an actuator device (not shown) is disposed in the upper area of the flushing cistern. The actuator device has two operating elements actuatable independently from each other. For example, the operating elements are designed as movably mounted push buttons, each push button being assigned to a lifting mechanism (not shown). The respective lifting mechanism is coupled with one of two pull tabs 2, 3 of drain valve 1, which at its upper end has an oblong lug 2.1, 3.1, into which the lifting mechanism engages.

Drain valve 1 has a valve housing 4 substantially formed in a sleeve-like manner. Valve housing 4 is open toward the bottom and at the upper end has two partition walls 4.1, 4.2 substantially running parallel and vertically offset to each other, which at the bottom delimit a floater or buoyant body chamber 4.3 and at the top delimit two reservoirs 5.1, 5.2. Partition walls 4.1, 4.2 are connected to each other by a partition wall 4.4, situated inside and substantially running vertically, and delimit a substantially centred through hole 6, through which a valve body 7 as an overflow pipe is guided in a liftable and lowerable manner.

Figure 8:
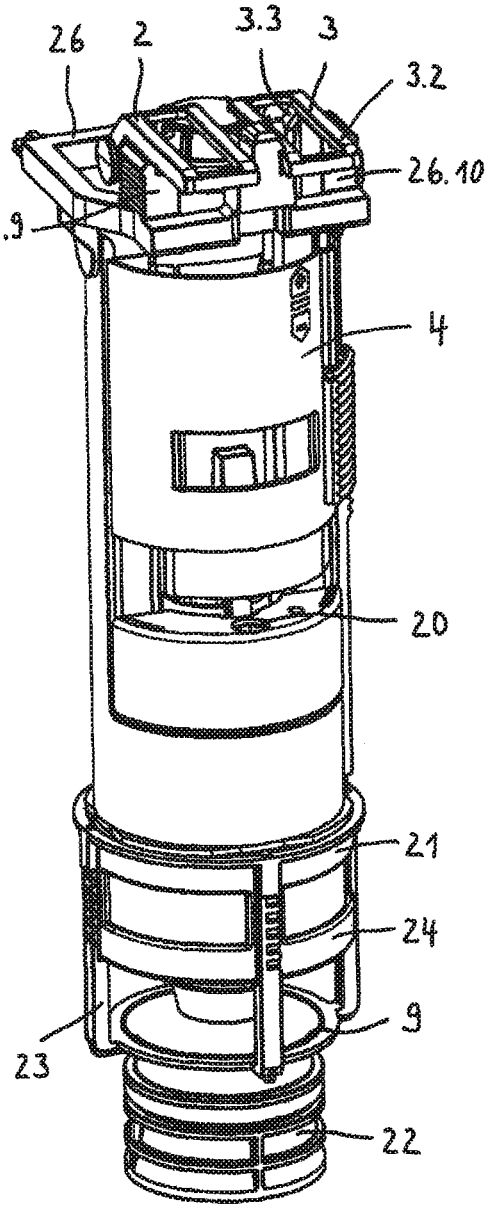

At the bottom end of valve body (overflow pipe) 7, an annular disc-shaped seal 8, which rests on a valve seat 9 when the drain valve is closed, is attached (see FIG. 8). Valve seat 9 preferably has a circumferential annular bead protruding upwards. Seal 8 is inserted into a annular groove formed at the outside of overflow pipe 7 and is preferably made from a rubbery-elastic material.

Furthermore, valve body 7 functioning as an overflow pipe is provided with a buoyant body (float) 10. Buoyant body 10 is fixedly connected to overflow pipe 7, disposed above seal 8 and guided in buoyant body chamber 4.3.

Valve housing 4 at the side is provided with through holes 11 situated at different heights, which serve as ventilation openings and enable an adjustment of the flushing water quantity released for a full flush. For this purpose, one of these through holes situated at the side is, with the aid of a slider 12, optionally opened and the remaining through holes are closed. Thus, different flushing quantities can be adjusted with the aid of slider 12 and through openings 11.

Top reservoir 5.1 is provided with a ventilation 13, which is configured as a through hole having a vertically moveable plug, and when triggering a flushing by pulling overflow pipe 7 upwards, a displacement of the water above buoyant body (float) 10 from valve housing 4 is possible.

Above lower reservoir 5.2, drain valve 1 has a container 14 open on the top for receiving water, which acts as an additional weight when triggering a partial flush, and which has an opening 15 at the side, which can be opened and closed via a slider 16. In other words, the height of an overflow edge of the container can be adjusted with the aid of slider 16. A lever 17 is assigned to container 14, which connects container 14 (as an additional weight) to overflow pipe 7 when triggering a partial flush.

One of two pull tabs 2, 3 is connected to valve body (overflow pipe) 7 for triggering a full flush, while the other pull tab is connected to container 14 for triggering a partial flush.

For triggering a full flush, overflow pipe 7 is pulled upwards by first pull tab 2. In this instance, water located above buoyant body 10 is displaced from chamber 4.3 and is pressed through the through hole provided with moveable plug 18. If buoyant body 10 fixedly connected to overflow pipe 7 has reached its uppermost position defined by bottom edge 4.41 of partition wall (guide wall) 4.4, plug 18 closes the through hole while water level W continues to drop in the flushing cistern. On account of closed ventilation 13, an underpressure is maintained in chamber extension 4.31 above buoyant body 10, which keeps the water in chamber extension 4.31 and prevents buoyant body 10 and, for this reason overflow pipe 7, from sinking. Annular gap 19 between overflow pipe 7 and valve housing 4 seals the space between valve housing 4 and buoyant body 10 in a limited manner, as a result of which the water level in the flushing cistern can sink below the water level in valve housing 4 and drain valve 1 at first still remains open. If the water level in the flushing cistern however reaches opened ventilation opening 11 in the side wall of valve housing 4, air flows into the valve housing, as a result of which the underpressure prevailing in the valve housing is cancelled. The water above buoyant body 10 now acts with its weight onto the buoyant body, as a result of which the buoyant body drops along with overflow pipe 7 and closes drain valve 1.

In contrast, for triggering a partial flush, container 14 is pulled upwards using second pull tab 3. Overflow pipe 7 is lifted with the aid of a movable bifurcated claw (not shown) connected to overflow pipe 7, which is fixedly connected to container 14 and to which a stop (not shown) formed at overflow pipe 7 is assigned. In this instance, water located above buoyant body 10 is again displaced from chamber 4.3 and is pressed through the through hole provided with moveable plug 18. If buoyant body 10 fixedly connected to overflow pipe 7 has reached it uppermost position defined by bottom edge 4.41 of partition wall 4.4, plug 18 closes the through hole, while the water level in the flushing cistern continues to sink. On account of the closed through hole (ventilation 13), again an underpressure, which keeps the water in chamber extension 4.31 and prevents a sinking of buoyant body 10 and, for this reason, of overflow pipe 7, is kept in chamber extension 4.31 above buoyant body 10. During the upward movement of container 14, lever 17 connected to container 14 pivots sideways as a result of a radial protrusion acting in valve housing 4, so that lever 17 grips onto a ledge 7.1 formed at overflow pipe 7 and, in this way, braces container 14 at overflow pipe 7, and so that container 14 does not immediately sink back into its starting position. If the water level in the flushing cistern falls below the height of container 14, the container acts with its water content as an additional weight at overflow pipe 7 and, for this reason, upon buoyant body 10. If the weight of container 14 including its water content is greater than the sum of the buoyancy force of buoyant body 10 and the underpressure above buoyant body 10, overflow pipe 7 falls downwards and drain valve closes. The height of opening edge (overflow edge) 14.1 at container 14 and, for this reason, the water content being able to be accommodated in container 14 may be adjusted with the aid of slider 16, and thus the additional weight may be adjusted. The less water container 14 receives, the longer drain valve 1 remains open during the partial flush. The partial flush is terminated at the latest when the water level in the flushing cistern reaches a through hole 20 formed in horizontal partition wall 4.2 of the valve housing, which is closeable by a plug 14.2 formed at the bottom side of liftable and lowerable container 14. Then, air flows through opened through hole 20 into chamber 4.3 of drain valve 1 and cancels the underpressure above buoyant body 10. The water above buoyant body 10 then acts by its weight onto the buoyant body, as a result of which the buoyant body lowers together with overflow pipe 7 and closes drain valve 1.

Furthermore, drain valve 1 at the bottom end of valve housing 4 includes a bracket 21 which has an outlet connecting piece 22, valve seat 9, vertical spacers 23 and an enclosure 24 accommodating valve housing 4. Outlet connecting piece 22 at its outside is provided with a sealing ring (O-ring) 25 and is inserted into an outlet connecting piece (not shown) of the flushing cistern, to which a flushing pipe leading to a toilet bowl is connected. Valve housing 4 is releasably connected or connectable to enclosure 24 of bracket 21 so that, by separating bracket 21 and valve housing 4, the overall length of drain valve 1 can be shortened for installing and removing the drain valve via the revision opening of the flushing cistern (see FIGS. 5 to 8).

At its upper end, valve housing 4 is provided with an integrated spacer 26 for aligning and fixing drain valve 1 in the flushing cistern. Spacer 26 is configured in a frame-like shape and is rotatably mounted at the upper end of valve housing 4. For this purpose, the spacer has articulated arms 26.1, 26.2 projecting downwards, which are rotatably mounted by a hole-pin connection at valve housing 4. This spacer 26 is thus pivotable about a rotary axis substantially extending horizontally relative to valve housing 4. The rotary axis of spacer 26 runs substantially parallel to a plane in which oblong lugs 2.1, 3.1 of pull tabs 2, 3 are located.

Figure 9:
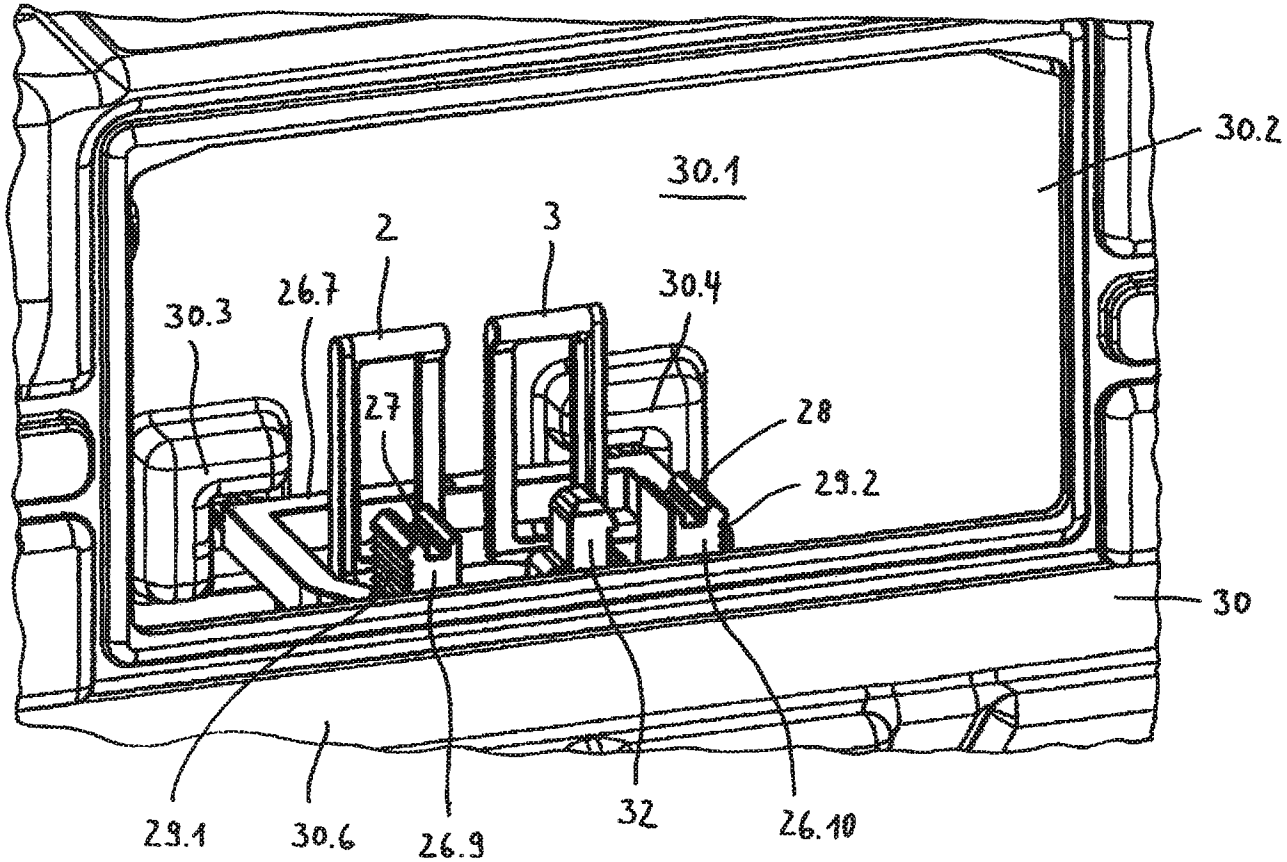
FIGS. 9 to 11 show in a perspective view a portion of the flush-mounted flushing cistern in the area of its revision opening, the two pull tabs of the drain valve being shown in their upright position in FIG. 9, one of the pull tabs being shown in its upright position in FIG. 10, and both pull tabs being shown in their folded position in FIG. 11.
Figure 10:
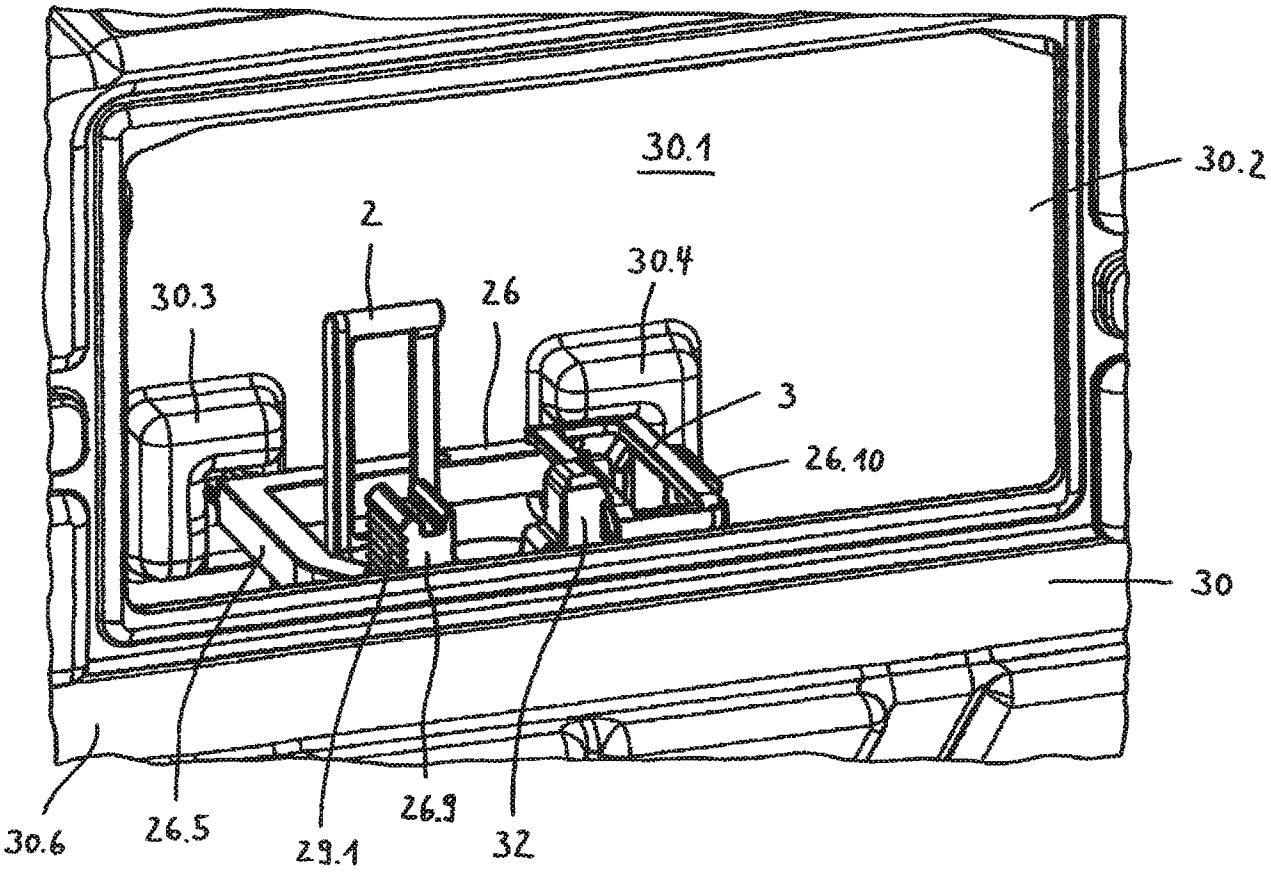
Figure 11:
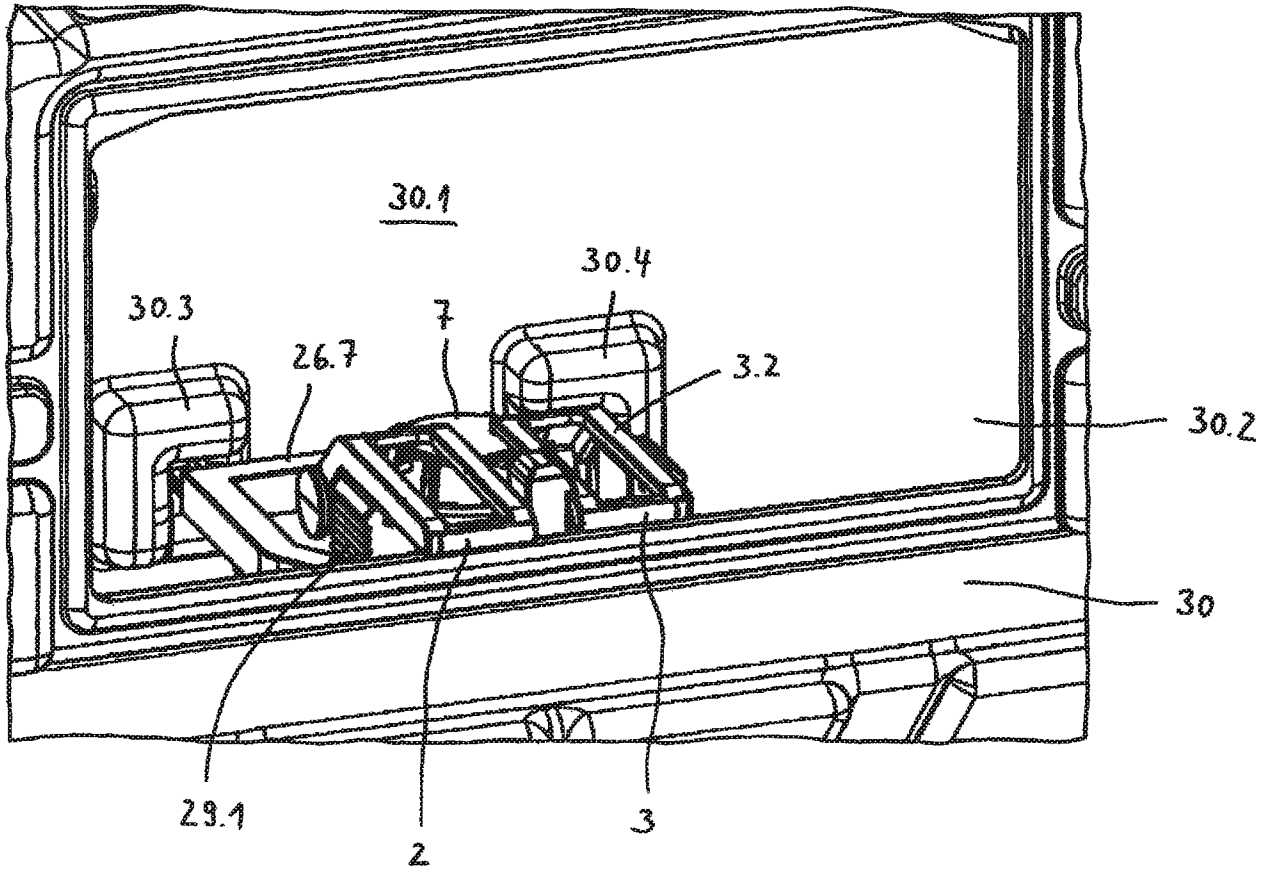

At its backside, integrated spacer 26 has two protrusions 26.3, 26.4 horizontally spaced apart, which are assigned to the rear wall of the flushing cistern. Rear wall 30.1 of flushing cistern 30, shown in FIGS. 9 to 11, at its inside has protrusions 30.3, 30.4, which serve for the positive locking of spacer 26. The protrusions are configured in such a manner that they can vertically and horizontally fix spacer 26 with drain valve 1 in flushing cistern 30 without requiring additional fixing means for this purpose. For this purpose, protrusions 30.3, 30.4 are preferably angularly formed at the inside of rear wall 30.1 of the flushing cistern (see FIG. 9).

In the installed state of drain valve 1, protrusions 26.3, 26.4 protruding at the rear side of spacer 26 grip around the bottom of angular protrusions 30.3, 30.4 of rear wall 30.1 of the flushing cistern. Seen in a cross-sectional view, protrusions 26.3, 26.4 of the spacer have, for example, a cruciform profile. The tips of protrusions 26.3, 26.4 facing rear wall 30.1 of the flushing cistern or the corners of the profile webs are preferably rounded.

As can be seen in particular in FIGS. 1 and 3, frame-shaped spacer 26 is tapered in the direction of its front side. Spacer 26 has cranked side rails 26.5, 26.6, rearmost rail 26.7 facing rear wall 30.1 of the flushing cistern having greater dimensions than front rail 26.8 of spacer 26 facing front wall 30.6 of flushing cistern 30.

Pull tabs 2, 3 of drain valve 1 are configured in a foldable manner. By folding pull tabs 2, 3, the overall length of drain valve 1 can be shortened, as a result of which the handling of drain valve 1 is significantly facilitated when installing and removing in flushing cistern 30 via revision opening 30.2 of the flushing cistern. Moreover, by folding over pull tab 2 connected to liftable and lowerable valve body (overflow pipe) 7, valve body 7 is lifted.

For this purpose, pull tab 2 is pivotably connected to valve body 7, spacer 26 having an abutment 26.9 assigned to pull tab 2, which functions as a pivot point for pull tab 2 so that pull tab 2 is movable from an upright position into a folded position and so that valve body 7 connected to pull tab 2 in the folded position of pull tab 2 is raised vis-à-vis valve seat 9.

The upper foldable portion of pull tab 2 is preferably configured in an angular shape. The upper foldable portion has a first segment 2.2 and a second segment 2.3 connecting as a single piece to the first segment, two segments 2.2, 2.3 enclosing an angle in the range of 130° to 140°, for example, enclosing an angle of approximately 135°. First segment 2.2 has oblong lug 2.1 of pull tab 2, while second segment 2.3 is pivotably connected to valve body (overflow pipe) 7 (see in particular FIGS. 6 to 8).

The upper, foldable portion of second pull tab 3 is preferably also configured in an angular shape. This portion also has a first segment 3.2 and a second segment 3.3 connecting as a single piece to the first segment, two segments 3.2, 3.3 again enclosing an angle in the range of 130° to 140°, for example, enclosing an angle of approximately 135°. Oblong lug 3.1 of second pull tab 3 is defined by first segment 3.2, while second segment 3.3 is pivotably mounted at the upper end of a pull tab portion 3.4 substantially vertically extending and connected to container 14. The upper end of pull tab portion 3.4 is arcuately formed and points in the direction of rearmost rail 26.7 of spacer 26.

Moreover, integrated spacer 26 of drain valve 1 has a second abutment 26.10 assigned to second pull tab 3, which functions as a pivot point for pull tab 3, so that pull tab 3 is movable from an upright position into a folded position. Abutment 26.9 assigned to first pull tab 2 as well as also abutment 26.10 assigned to second pull tab 3 protrude at the top side of spacer 26 and respectively have a groove 27, 28 for receiving a portion 2.2, 3.2 defining a portion of pull tab 2, 3 or of lug 2.1, 3.1. Two abutments 26.9, 26.10 at their outsides facing away from each other respectively have a three-dimensionally structured gripping surface 29.1, 29.2 so that spacer 26 can easily be gripped using thumb and index finger.

Furthermore, spacer 26 is provided with a latching element 32, with the aid of which pull tab 3 in its folded position can be releasably latched at spacer 26. Latching element 32 is formed in a nose-like manner and engages over the portion of pull tab 3 defining lug 3.1.

The implementation of the invention is not limited to the exemplary embodiments illustrated in the drawing and described above. Rather, a plurality of variants is conceivable, which also can make use of the invention indicated in the appended claims if the configuration deviates from the drawing and the description.

The invention claimed is:

1. A drain valve for a sanitary flushing cistern, in particular a flush-mounted flushing cistern, comprising a valve housing and a valve body guided in the valve housing and configured as an overflow pipe having a seal assigned to a valve seat, wherein the valve body is provided with at least one pull tab for lifting the valve body, and one buoyant body, wherein the valve housing at its upper end is provided with a spacer for aligning and fixing the drain valve in the flushing cistern, wherein the pull tab is pivotably connected to the valve body and the spacer has an abutment assigned to the pull tab, which functions as a pivot point for the pull tab, so that the pull tab is movable from an upright position into a folded position and the valve body connected to the pull tab in the folded position of the pull tab is raised vis-à-vis the valve seat.

2. The drain valve according to claim 1, wherein the spacer is rotatably mounted at the upper end of the valve housing.

3. The drain valve according to claim 2, wherein the spacer has downward facing articulated arms, which are rotatably mounted by pins at the valve housing.

4. The drain valve according to claim 1, wherein the spacer is configured in a frame-like shape and at its rear side has one or a plurality of protrusions assigned to the rear wall of the flushing cistern.

5. The drain valve according to claim 4, wherein the frame-shaped spacer is tapered in the direction of the abutment assigned to the pull tab.

6. The drain valve according to claim 1, wherein the abutment assigned to the pull tab protrudes at the top side of the spacer and has a groove for receiving a portion of the pull tab.

7. The drain valve according to claim 1, wherein the drain valve is configured as a dual flush drain valve and has a second pull tab pivotably attached at the drain valve, wherein the spacer has a second abutment assigned to the second pull tab, which functions as a pivot point for the second pull tab, so that the second pull tab is movable from an upright position into a folded position.

8. The drain valve according to claim 7, wherein the two abutments at their outsides facing away from each other respectively have a three-dimensionally structured gripping surface.

9. The drain valve according to claim 1, wherein the spacer is provided with a latching element, with the aid of which the first-mentioned pull tab for the second pull tab in its folded position can be releasably latched to the spacer.

10. The drain valve according to claim 1, wherein the valve housing at its lower end is provided with a bracket including the valve seat, vertical spacers and an outlet connecting piece, wherein the valve housing is releasably connected to the bracket.

11. A sanitary flushing cistern, preferably in the form of a flush-mounted flushing cistern, comprising a rear wall, a front wall and a drain valve, wherein in the upper portion of the front wall a revision opening is formed for installing and removing the drain valve, wherein the drain valve is configured according to claim 1.

12. The flushing cistern according to claim 11, wherein the rear wall at its inside has at least one recess and/or at least one protrusion for positively locking the spacer.

* * * * *